United States Patent [19]

McKannan et al.

[11] Patent Number: 5,023,050

[45] Date of Patent: Jun. 11, 1991

[54] SUPERALLOY FOR HIGH-TEMPERATURE HYDROGEN ENVIRONMENTAL APPLICATIONS

[75] Inventors: Eugene C. McKannan; William B. McPherson, both of Huntsville, Ala.; Shaffiq Ahmed, Youngstown, Ohio; Shirley S. Chandler, Huntsville, Ala.

[73] Assignee: The United States of America as represented by the Administrator of the National Aeronautics and Space Administration, Washington, D.C.

[21] Appl. No.: 425,904

[22] Filed: Oct. 24, 1989

[51] Int. Cl.[5] ..... C22C 19/05; C22F 1/10

[52] U.S. Cl. ..... 420/448; 148/410; 148/428

[58] Field of Search ..... 420/448; 148/410, 428

[56] References Cited

U.S. PATENT DOCUMENTS 4,769,087 9/1988 Genereux et al. ..... 148/2

4,853,044 8/1989 Ford et al. ..... 148/410

*Primary Examiner*—R. Dean

*Assistant Examiner*—Margery S. Phipps

*Attorney, Agent, or Firm*—Jerry L. Seemann; Robert L. Broad, Jr.

[57] ABSTRACT

A nickel-based superalloy is provided which is resistant to deterioration in hydrogen at high operating temperatures and pressures, and which thus can be used in hydrogen-fueled spacecraft such as the Space Shuttle. The superalloy is characterized by a two-phase microstructure and consists of a gamma-prime precipitated phase in a gamma matrix. The gamma matrix phase is a primary solid solution and the gamma precipitated phase will be an intermetallic compound of the type $A_3B$, such as nickel aluminide or titanide. Both phases are coherent, ordered, and compatible, and thus will retain most of their strength at elevated temperatures. The alloy consists essentially of (by weight):

| | |
|---|---|
| Ni | 50–60% |
| Cr | 10–20% |
| Al | 2–6% |
| Co | 2–5% |
| Ti | 3–8% |
| W | 5–12% |
| Mo | 5–10% |
| Nb | 1–3% |

wherein the ratio W/MO is approximately equal to 1, and Ti/Al ranges from about 1 to about 2.

10 Claims, 1 Drawing Sheet

SUPERALLOY FOR HIGH-TEMPERATURE HYDROGEN ENVIRONMENTAL APPLICATIONS

ORIGIN OF THE INVENTION

The invention described herein was made in the performance of work under a NASA contract and is subject to the provisions of Public Law 96-517 (35 USC 202) in which the contractor has elected not to retain title.

FIELD OF THE INVENTION

The invention relates to a Nickel-based superalloy suitable for use in high-temperature hydrogen environments, such as those encountered in rocket engines, which is characterized by a primary solid solution gamma matrix phase and a precipitated gamma-prime phase.

BACKGROUND OF THE INVENTION

Rocket engines depend on hydrogen for fuel and require high strength, tough materials which are not embrittled by the hydrogen. At the leading edge of technology in this field, the present Space Shuttle Main Engine (SSME) has been designed for orbital space flight and has developed approximately a one-half million pound sea level thrust. Its turbines operate at extremely high speed and high pressure using hydrogen and steam as the working fluids. The turbine blades of the fuel turbo pumps are subjected to high alternating stresses together with extreme thermal transients. It is therefore crucial that the alloy employed in the SSME be one which is capable of withstanding these extreme conditions.

At present, the alloy used in the Space Shuttle Main Engine and other rocket engines is an alloy known as MAR-M-246(Hf), which is in the directionally-solidified and heat treated condition. This alloy was originally designed for gas-turbine engines, and has been adapted for use in the turbine blades of the SSME turbo pump, even though the operating conditions of rocket engines are different from those of the gas-turbine engines. This alloy has been able to meet the initial structural requirements, but is somewhat limited in life. Further, the initial strength of the material is only 60% in hydrogen when compared to air, and notch strength ratio is 18%. The MAR-M-246(Hf) is a multi-phase polycrystalline alloy, and the behaviors of these phases are vastly different due to their individual characteristics. Most of these phases deteriorate under the extremely demanding service conditions. For example, carbides, which are employed in the alloy and originally are of small size, will tend to coagulate, becoming large enough to be potential centers of stress under the rigorous pressure and temperature conditions. They will eventually be responsible for initiating and propagating cracks which may ultimately cause failure.

It is also important to note that the carbide-formers have been intentionally added to strengthen the grain boundaries against creep and grain growth phenomena at high temperatures. However, most of these carbide-formers are known to lower the solvus temperature of the gamma-prime phase, thereby drastically reducing its most beneficial effect as the effective strengthener of the matrix. It is thus almost impossible to control or inhibit the diverse changes in all of the various phases at the same time. The depletion of alloying elements will precede at different rates in different phases and will cause severe loss in strength in many areas. Moreover, the grain boundary and the gamma/gamma-prime interface areas, being high energy areas, will be highly susceptible to environmental degradation by attracting hydrogen to these regions. The result will be a deterioration by embrittlement of this alloy, thereby shortening its effective lifetime.

A more desirable alloy should have fewer phases, and these phases should be compatible and controllable in a structural sense. The alloy should not contain any grain boundary or undesirable phase such as the topologically close packed (TCP) phases. The alloy used in the fuel turbine blade of rocket engines must be resistant to hydrogen in addition to having high strength, good fatigue characteristics, and good creep rupture strength at elevated temperatures. All known present superalloys are incapable of meeting the rigorous demands for repeated space flights even of short duration.

SUMMARY OF THE INVENTION

A Nickel-based superalloy suitable for use in high-temperature hydrogen environments such as would be experienced in the Space Shuttle Main Engine, is provided in the present invention which consists essentially of the following composition by weight:

| Elements | Percentages |
|---|---|
| Ni | 50-60% |
| Cr | 10-20% |
| Al | 2-6% |
| Co | 2-5% |
| Ti | 3-8% |
| W | 5-12% |
| Mo | 5-10% |
| Nb | 1-3% |

This alloy is resilient to the high temperature conditions and hydrogen environment found in the space shuttle, and is comprised of a two phase microstructure consisting of a gamma-prime precipitated phase in a gamma matrix phase which will be a primary solid solution. These phases are coherent, ordered and compatible, and thus the alloy retains its strength and stability at elevated temperatures.

DETAILED DESCRIPTION OF THE PREFERRED EMBODIMENTS

Figure 1:
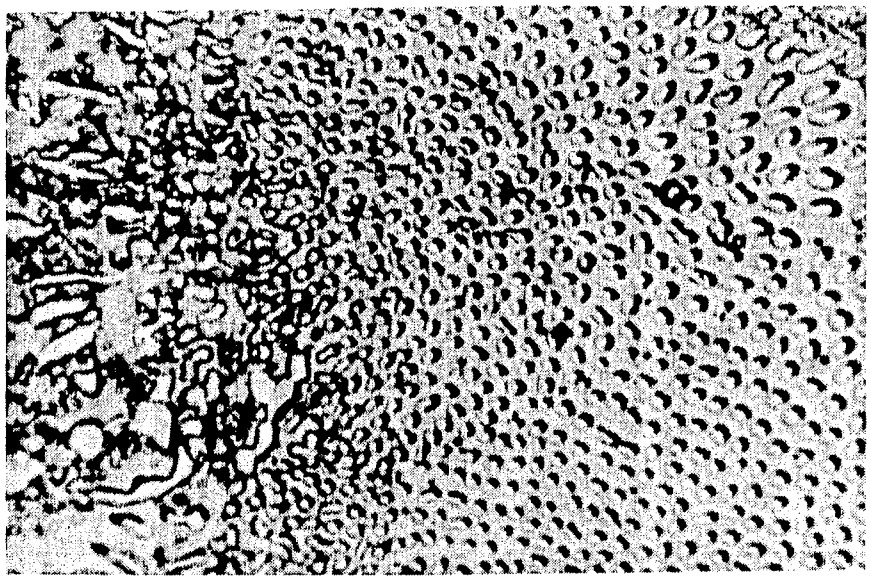
FIG. 1 is a photomicrograph, which has been magnified approximately 800 times, showing the microstructure of the alloy.

The present invention is the result of research based on a different approach of defining a metallurgical structure that will satisfactorily meet all the desired service requirements. As indicated above, the turbines of the space shuttle operate at extremely high speed and high pressure using hydrogen, and the turbine blades of the fuel turbo pumps are

TABLE 1

| PROJECTED DESIGN PARAMETERS & PROPERTY REQUIREMENTS |
|---|
| Mechanical properties in air |
| U.T.S. - 135 KSI |
| Y.S. - 115 KSI |
| Elongation - 6% |
| Reduction of area - 10% |

TABLE 1-continued

| PROJECTED DESIGN PARAMETERS & PROPERTY REQUIREMENTS |
|---|
| Temperature Ranges |
| Thermal transients of 3200 R/0.5 sec |
| Steady state operational temperature - 1800 R |
| Environment of operation |
| Hydrogen rich and |
| $H_2/H_2O$ ratio - 6/1 |
| Projected design parameters at 800 C. |
| Tensile Strength |
| UTS - 1300 MPa |
| YS (0.2%) - 1200 MPa |
| Reduction of area - 15% |
| Elastic modulus - 100 GPa |
| Poisson's ratio - 0.34 |
| Stress rupture strength |
| 100 KSI at 900 C. for 10 hour rupture life |
| Thermal expansion - $0.8 \times 10^{-3}$ Cm/Cm |
| Thermal conductivity - 15 W/M-K |
| Specific heat - 600 J/Kg-K |

TABLE 2

| PROPERTY REQUIREMENTS |
|---|
| High strength at elevated temperatures |
| Retention of ductility and toughness |
| Good creep rupture strength at high temperature |
| High thermal conductivity |
| Low thermal expansion |
| Resistant to |
| Fatigue |
| Failure life: |
| HCF - 7.5 hrs. |
| LCF - 240 cycles |
| Hydrogen embrittlement |
| Strain to cracking in Hydrogen - 2% max |
| Strength degradation in Hydrogen - 10% max |
| Thermal shock |
| Oxidation |

subjected to high alternating stresses together with extreme thermal transients. The alloys used in these structures must be resistant to deterioration in hydrogen at all operating temperatures and pressures. The important and projected design parameters of these turbine blades are summarized together with a qualitative description of properties required in Tables 1 and 2. As can be observed in these tables, high strength at elevated temperatures combined with good resistance to the hydrogen environment is crucial for the alloy to be used in the turbines of the SSME.

In accordance with the present invention, an alloy is provided which can be either a single phase or a two-phase structure in a Nickel-based superalloy without grain boundaries. In the preferred embodiment of the present invention, the alloy comprises a two-phase microstructure consisting of a gamma-prime precipitated phase in a gamma matrix phase in a Nickel-based superalloy. In this embodiment, the matrix phase comprises a primary solid solution and the gamma-prime precipitated phase is an intermetallic compound of type $A_3B$, wherein A and B are selected from the group consisting of nickel, cobalt, aluminum, niobium and titanium. Most preferably, the gamma-prime intermetallic compound $A_3B$ is nickel aluminide or nickel titanide. Both of these phases are capable of being strengthened by solid solution with other or possibly the same alloying elements and both phases have the same crystal structure with very little lattice parameter difference between them. Both phases retain most of their strength at elevated temperatures, and have base chemical compositions close to each other. The phases are equilibrium phases, and are coherent, ordered and compatible.

It is also preferred that the precipitated gamma-prime phase be uniformly dispersed by nucleation and precipitation methods. The precipitated gamma-prime phase is spherical in shape, small in size, and finely distributed. The amount of gamma-prime phase is as high as possible for stability and strength, since the gamma-prime phase is known to have higher strength at elevated temperatures. The gamma-prime phase is stable against coagulation and growth at the elevated temperatures.

The physical characteristics of the gamma-prime phase have important effects on the strength and durability of the alloy. The strength of the alloy increases with temperature due to the dislocation motion impediments characteristic of this phase. A decrease in the size of the precipitated phase particles increases elongation. A large amount of gamma-prime retards coalescence of the particles. The spherical shape of the gamma-prime phase minimizes the total energy of the system, which is comprised of the interface energy between the phases, the strain energy resulting from the lattice mismatch, and the elastic interaction energy between the phases. The lattice mismatch is small since any increase in it will increase the agglomeration characteristics of the precipitated phase. However, the high-temperature characteristics improve with increasing lattice mismatch. Finally, the gamma-prime phase is stable against growth to retain its fine dispersion. This is achieved by slowing its growth rate by the addition of proper alloying elements to increase the activation energy for diffusion, Q, and the diffusion coefficient, D.

Several considerations are taken into account when choosing the alloying elements in the Nickel-based superalloy of the present invention. For instance, the solute alloying element must be soluble in the solvent (Nickel) to the extent of forming a primary solid solution to be effective. Also, the solute atom influences the characteristics of the solid solution through its differences between it and the solvent atom in physical parameters such as the ionic radius, electronic configuration, and the valance electron contribution to the energy band of the solid solution. Finally, the stability of solid solution together with the kinetics of changes taking place at operating temperatures and conditions must be maximized. The alloying element in the presence of other alloying elements will change the solubility, relevant diffusion parameters, stability and solvus temperature of the solid solution. The important and relevant parameters of several alloying elements can be observed in Table 3.

In accordance with the present invention, a Nickel-based superalloy suitable for use in high-temperature hydrogen environments is provided which, in the preferred embodiment, comprises the following composition by weight:

| Element | Percentage |
|---|---|
| Nickel | 50-60% |
| Chromium | 10-20% |
| Aluminum | 2-6% |
| Cobalt | 2-5% |
| Titanium | 3-8% |
| Tungsten | 5-12% |
| Molybdenum | 5-10% |
| Niobium | 1-3% |

All elements having some solubility in Nickel strengthen the solid solution of the alloy, the strengthening effect being dependent on the differences between the ionic radii and valance electron concentrations. Tungsten (W) is preferred and makes an outstanding contribution to the alloy because it has a high solubility in Nickel. It is preferred that the Tungsten-Molybdenum (W/Mo) ratio should be about one for better properties at elevated temperatures. Chromium (Cr) and Aluminum (Al) improve the oxidation resistance and hot corrosion properties of the alloy. These two elements along with Molybdenum and Tantalum (Ta) improve the high-temperature properties of the alloy as well. Aluminum and Titanium (Ti) form the precipitated gamma-prime phase, $A_3B$. The Ti/Al ratio is preferably greater than 1 and less than 2 to increase the energy of the Anti-Phase Boundary (APB), which will strengthen the intermetallic combination against dislocation motion. The shape, size, and volume of the gamma-prime phase are controlled by the alloying elements together with proper solidification processing along with suitable heat treatment and again procedures. The alloying elements such as Cr, Co, Ti, Al, and Mo, increase the amount of gamma-prime phase.

In the alloy of the present invention, the coarsening of the gamma-prime phase decreases with the decrease in lattice mismatch between the two phases. The lattice mismatch is possible to control by controlling the choice of alloying elements and their relative amounts. It is preferred in the present invention to employ the element Niobium (Nb), which inhibits the coarsening of the gamma-prime phase. This also retards its growth by increasing both the diffusion parameters mentioned above. Cobalt (Co) is employed to lower the solvus temperature of gamma-prime, and to increase its amount.

The important and relevant parameters of the alloying elements employed in the invention are presented in Table 3. In addition, it is important to note that some alloying elements dissolve only in one of the two phases, while others partition themselves between the phases. The approximate partitioning of the elements can be observed in Table 4. The dissolution of the alloying elements becomes important when determining difference between the lattice parameters of the two phases. When selecting alloying elements and their relative amounts, it is important to know their individual solubility limits and the possible changes to those limits caused by other alloying elements during formation of a primary solid solution. Alloying elements are distributed between the gamma matrix phase and the gamma-prime phase in accordance with the partitioning parameters, assuming that the complete precipitation has taken place after appropriate heat treatment. The preferred percentage of the gamma-prime phase in the alloy of the present invention is around 70%. The lattice mismatch in the alloy was determined to be about 0.003. A photomicrograph of an alloy prepared in accordance with the present invention is observed in FIG. 1, and has a composition of Ni 55%, Cr 15%, Al 4%, Co 3%, Ti 5%, W 8%, Mo 8%, and Nb 2%.

An alloy having the composition and characteristics as described above can be prepared by a number of suitable methods. However, the alloy of the invention is preferably prepared under a vacuum in an induction furnace, then homogenized and cast into an ingot. The ingot is given diffusion anneal at a temperature of from about 2,000° F. to about 2,200° F. for about 48 hours. At this point, several pieces can be cut from the ingot for further processing. The processed pieces are solution-treated at around 2,100°-2,200° F. for a period of about 40 hours, and then water quenched. Finally, the pieces are given a triple aging treatment which comprises the following steps:

1. 2,000°-2,100° F. for about 25-30 hours with water quench;
2. 1,700°-1,800° F. for about 10-20 hours with water quench; and
3. 1,300°-1,500° F. for about 10-15 hours followed by air cool.

The above procedure results in an alloy having a unique microstructure comprised of a solid solution strengthened gamma matrix phase with a strengthened and precipitated gamma-prime phase. The gamma-prime phase is uniformly distributed in the alloy and has a spherical shape, as observed in the drawing figure, with a size ranging from about 0.001 to about 0.01 microns. The alloy, once heat treated and aged properly, exhibits superior strength characteristics in high-temperature environments, and is resistant to hydrogen embrittlement. As a result, the alloy of the present invention can be used to withstand the rigorous conditions observed in the hydrogen-fueled engines of spacecraft such as the Space Shuttle.

TABLE 3

IMPORTANT PARAMETERS OF ALLOYING ELEMENTS

| Elements | Atomic Number | Atomic Weight | Atomic Volume | Electronic Structure |
|---|---|---|---|---|
| Aluminum | 13 | 26.98 | 16.6 | $1S^2..3S^22P^1$ |
| Titanium | 22 | 47.90 | 17.65 | $1S^2..3d^24S^2$ |
| Cobalt | 27 | 58.94 | 11.13 | $1S^2..3d^74S^2$ |
| Nickel | 28 | 58.71 | 10.94 | $1S^2..3d^84S^2$ |
| Niobium | 41 | 92.91 | 17.98 | $1S^2..4d^45S^1$ |
| Molybdenum | 42 | 95.95 | 15.58 | $1S^2..4d^55S^1$ |
| Tantalum | 73 | 180.95 | 18.61 | $1S^2..5d^36S^2$ |
| Tungsten | 74 | 183.86 | 15.85 | $1S^2..5d^46S^2$ |

| Elements | Crystal Structure | Nearest Neighbor distance (a) | Distance of closest Approach (a) | Valence (Pauling) | Electron Hole Number |
|---|---|---|---|---|---|
| Aluminum | FCC | 2.863 | 1.502 | 3 | 7.66 |
| Titanium | HCP | 2.894<br>2.951 | 1.614 | 4 | 6.66 |
| Cobalt | HCP | 2.497<br>2.509 | 1.385 | 6 | 1.71 |
| Nickel | FCC | 2.492 | 1.377 | 6 | 0.66 |
| Niobium | BCC | 2.858 | 1.625 | 5 | 5.66 |
| Molybdenum | BCC | 2.725 | 1.550 | 6 | 4.66 |
| Tantalum | BCC | 2.860 | 1.626 | 5 | 5.66 |
| Tungsten | BCC | 2.741 | 1.549 | 6 | 4.66 |

TABLE 4

PARTITIONING OF ELEMENTS

| Elements | Gamma Phase | Gamma prime phase |
|---|---|---|
| Al | 0.246 | 1 |
| Co | 1 | 0.34 |
| Cr | 1 | 0.13 |
| Mo | 1 | 0.31 |
| Nb | <0.05 | 1 |
| Ta | <0.05 | 1 |
| Ti | 0.09 | 1 |
| W | 1 | 0.83 |

What is claimed is:

1. A nickel-based superalloy suitable for use in high-temperature hydrogen environments, consisting essentially of: ten (10) to twenty (20) percent by weight of chromium (Cr); two (2) to six (6) percent by weight of aluminum (Al); two (2) to five (5) percent by weight of cobalt (Co); three (3) to eight (8) percent by weight of titanium (Ti); five (5) to twelve (12) percent by weight of tungsten (W); five (5) to ten (10) percent by weight of molybdenum (M0); and one (1) to three (3) percent by weight of niobium (Nb); balance fifty (50) to sixty (60) percent by weight of nickel (Ni);

wherein the tungsten/molybdenum ratio is approximately equal to one (1) and the titanium/aluminum ratio is from about one (1) to about two (2).

2. A superalloy according to claim 1, having a two-phase microstructure comprising a gamma matrix phase and a gamma-prime precipitated phase.

3. A superalloy according to claim 2, wherein the gamma matrix phase comprises a primary solid solution.

4. A superalloy according to claim 2, wherein the gamma-prime precipitated phase is formed by aluminum and titanium.

5. A superalloy according to claim 2, wherein the gamma-prime precipitated phase comprises compounds of the type $A_3B$, wherein A and B are selected from the group consisting of nickel, colbalt, aluminum, niobium and titanium.

6. A superalloy according to claim 5 wherein the gamma-prime precipitated phase comprises compounds selected from the group consisting of nickel aluminide and nickel titanide.

7. A superalloy according to claim 2, wherein both phases are equilibrium phases.

8. A superalloy according to claim 2, wherein the precipitated gamma-prime phase is uniformly dispersed.

9. A superalloy according to claim 2, wherein the gamma-prime phase is spherical in shape, small in size, and finely distributed.

10. A superalloy according to claim 9, wherein the size of the gamma-prime precipitated phase ranges from about 0.001 to about 0.1 microns.

* * * * *